US008376920B2

(12) United States Patent
Anderson

(10) Patent No.: US 8,376,920 B2
(45) Date of Patent: Feb. 19, 2013

(54) METHOD AND APPARATUS FOR INCREASING EFFECTIVENESS OF ABDOMINAL EXERCISES

(76) Inventor: Jeffrey T. Anderson, West Yarmouth, MA (US)

( * ) Notice: Subject to any disclaimer, the term of this patent is extended or adjusted under 35 U.S.C. 154(b) by 184 days.

(21) Appl. No.: 12/437,017

(22) Filed: May 7, 2009

(65) Prior Publication Data

US 2009/0280970 A1 Nov. 12, 2009

Related U.S. Application Data

(60) Provisional application No. 61/071,586, filed on May 7, 2008.

(51) Int. Cl.
*A63B 26/00* (2006.01)

(52) U.S. Cl. ..... 482/140

(58) Field of Classification Search ..... 482/51–53, 482/74, 91–92, 121–126, 128, 131–133, 482/139, 140, 142; 128/845; 602/13, 19
See application file for complete search history.

(56) References Cited

U.S. PATENT DOCUMENTS

| | | | | |
|---|---|---|---|---|
| 5,431,618 | A * | 7/1995 | Levi | 482/142 |
| 5,611,765 | A * | 3/1997 | Koch, Jr. | 482/142 |
| 5,647,829 | A * | 7/1997 | Rivas | 482/142 |
| 5,755,647 | A * | 5/1998 | Watnik | 482/121 |
| 6,371,894 | B1 * | 4/2002 | Hill | 482/121 |
| 6,881,179 | B2 * | 4/2005 | Mostardi | 482/91 |
| 2002/0098947 | A1 * | 7/2002 | Brown | 482/23 |
| 2005/0020417 | A1 * | 1/2005 | Gary | 482/140 |
| 2007/0173391 | A1 * | 7/2007 | Edwards | 482/142 |
| 2008/0096740 | A1 * | 4/2008 | Nichols | 482/121 |

* cited by examiner

*Primary Examiner* — Oren Ginsberg

(74) *Attorney, Agent, or Firm* — Clark & Brody

(57) ABSTRACT

Apparatus in the form of a wedge made of foam having a density capable of maintaining a user's spine extended during use is employed during abdominal exercise to prevent posterior pelvic tilt (PPT) during the exercise and thereby promote elastic remodeling of the spinal ligament.

7 Claims, 4 Drawing Sheets

METHOD AND APPARATUS FOR INCREASING EFFECTIVENESS OF ABDOMINAL EXERCISES

CROSS REFERENCE TO RELATED APPLICATIONS

This application claims priority of U.S. Provisional Application 61/071,586, which was filed on May 7, 2008.

FIELD OF THE INVENTION

The present invention relates to a support comprising a foam material and its use to reduce stress on the lower back during abdominal exercises by keeping the spine extended.

DESCRIPTION OF THE RELATED ART

Sitting in chairs and on flat surfaces, such as benches or the floor, is the cause of the overwhelming majority of lower back problems. Manifestation of back problems, be they degenerative conditions such as disc disease, spondylosis, arthritis, stenosis, etc., or acute back spasms and even disc herniation all originate from the act of sitting. These pathologies develop from mechanical insults secondary to sitting. Sitting creates a mechanical loading of the supportive soft tissues of the lower back that forces these tissues to change their structure and function. Sitting during the most physically developmental years of our lives predisposes us to experience back problems regardless of our occupation.

There are a number of mechanisms by which sitting creates back problems. First, is the process of creep. In reference to our spinal mechanics, creep is the elongation of our supportive soft tissues beyond their intrinsic extensibility, resulting from a constant load over time. Supportive soft tissues include muscles, tendons, ligaments, discs and fascia. These tissues are designed to grow to be of a certain tensile strength and length. The creeping process gradually lengthens these tissues so they no longer assume appropriate lengths. The creeping process also weakens or fatigues these tissues in the same way a paper clip will fatigue from repeated bending. The creeping process creates loading or weight bearing of the supportive soft tissues that is not alleviated from simply standing or lying down. The length change and laxity in these tissues introduces instability in human spines and it begins during the most developmental years of our lives. The mechanism through which the creeping process occurs is sitting creates a posterior-pelvic tilt (PPT), or a backward tilting of the pelvis. This in turn places the lumbar spine in flexion, or a rounded lower back posture. PPT and subsequent flexion of the lumbar spine causes stretching of all supportive soft tissues in the spine behind the central pivot point and compression of the discs in front of the central pivot point. The central pivot point is the nucleus of the inter-vertebral disc.

The second complication caused by sitting is the disruption of normal afferent or sensory signals from specialized muscles in our lower backs that are designed to detect position changes and are responsible for modulating reflex motor actions of other muscles linked to spinal stability. There are four muscle layers in the human spine. The two deepest layers are made up of muscles called rotatores and multifidi. These muscles act as length transducers or position sensors in the spine and lend stability to the spine by sending neurologic information to the spinal cord regarding postural changes in the body. The spinal cord then sends neurologic signals back to these muscles that provide stabilization to the spinal column as we move. This neuromuscular connection is called proprioception. If the load on these tissues is too great the strength of the signal sent to the cord cause an additional neural reflex that sends a signal to the more superficial stabilizers of the spine to change length and become tonic demonstrating a greater effort to stabilize the spine. Sitting creates excessive loading on these tissues such that an inhibitory signal is sent to the spinal cord. This abnormal sensory input has been linked to abnormal recruitment patterns, spasm, and eventual inhibition of both the deep and superficial muscles, leading to pain and increased tissue damage. Also, when inhibited the local spinal muscles role of stabilization is lost and the demands on the passive, i.e. ligaments, of the spine increases. Over time these tissues become subjected to repetitive stress like injuries and chronic low level inflammatory responses that are also linked to low back pain and have been shown to be a causative factor in disc herniation. The spinal cord then sends a neurologic signal back to these muscles that tells them to increase their tonic contraction, i.e. spasm. Eventually, some of the supportive ligaments of the spinal column create the same neuromuscular effect when they are under load.

The third complication from sitting is a phenomenon known as gluteal amnesia. Although the mechanism is yet to be understood, compression of the glateal complex, i.e., gluteus maximus, gluteus medius, and gluteus minimus from sitting inhibits the normal functioning of these muscles. The primary function of the gluteal muscles is extension of the hip. In human movement this motion is performed during walking or running, walking up stairs or coming up from a squatting position or lifting. The muscles that take over these functions secondary to the onset of gluteal amnesia include the hipflexors, quadriceps, hamstrings and lower back muscles. This frequent repetitive demand on the back muscles increases the insult to our spines.

The last complication from sitting is adaptive shortening of the hip flexor (psoas muscle) and the hamstrings. Because these muscles are held in shortened positions while we are seated, they adapt to this length change. Because of the attachments of these muscles i.e. origins and insertions, shortening of these muscles accentuates PPT. Shortened muscles also become dominant and this combined with gluteal amnesia means we no longer walk by "pushing" our bodies forward with our gluteal complex, but begin to "pull" our bodies forward with our psoas muscles. The psoas attaches from the front of the lumbar spine at an oblique angle to the top of the femur and recreates a PPT with each contraction. Body movements that recruit psoas muscle contraction, such as walking and running therefore insult the spine with a load equivalent to the force of contraction of the psoas. Traditional core strengthening exercises designed to aid back pain can therefore be insulting to the lower back if they recruit the psoas muscle for the exercise. The psoas muscle is a hip flexor muscle, it is therefore involved in any motion that flexes the hip or trunk. Examples include flattening the lower back on the floor, leg raises, sit ups or crunches. The force on the lumbar spine of a traditional abdominal crunch is approximately 730 lb. This load is the upper limit of what NIOSH Rational Institute of Occupational Safety and Health) standards consider to be a safe load on a human spine.

Improper exercise often results in injuries particularly to ligaments and joints. One may risk injury even performing routine exercises. For example, some of the more popular ways to improve abdominal and back fitness are crunches, sit-ups and the like. One lies on a flat surface and contracts the abdominal muscles to lift the upper body off the surface. While helpful, these exercises also bring a risk of potential injury and strain on the lower back vertebrae and spinal discs of the spinal column because these exercises recruit the hip flexor muscle in order to create the movement. The exercises therefore create hip/trunk flexion and recreate PPT.

FIG. 1 depicts a diagram of a lower back area 100 of the spine during an abdominal exercise. Hip bone 102 is attached to the spinal column, which includes back vertebrae 104, 106, 108 and 110. Spinal discs 103 lie between the vertebrae to cushion or prevent them from rubbing against each other. Hip flexor muscles 112 and back muscles 114 also are shown in relation to hip bone 102 and vertebrae 104-110. Abdominal exercises, such as crunches and leg raises, flex these muscles 112 and stretch muscles 114.

Any abdominal or core conditioning exercise that creates trunk or hip flexion uses hip flexor muscles 112 to perform the exercise. The exercise also creates a backward pelvic tilt, similar to the tilt found while sitting in a poor posture. The tilt creates a strain on the spinal tissues, joints and discs. The spine also may be impacted by the stress placed on the lower back region. As one does the crunch, a downward force F of as much as 730 pounds is placed on the spine through flexion of the spine.

Contraction, or recruitment, of hip flexor muscles 112 during any exercise flexes the spine and strains the lower back muscles, ligaments, joints, tendons and spinal discs. The spine flexion also impacts the front of the vertebral bodies, compressing the front of the discs and forcing increased pressure to the back of the discs. Referring to FIG. 1, the upper edges of spinal discs 103 are pressed together as the spine curves, thereby increasing the potential for disc herniation. All of these actions weaken spinal discs 103.

The action of strengthening muscles such as the abdominal wall, oblique muscles and hip flexors, i.e., the "core," accentuate this spinal flexion. Although strengthening of the core is beneficial for lower backs, the movements that perform trunk/hip flexion place substantial negative forces on the lower back. If the core strength development does not overcome the damage done by these movements, then the back pain for that individual may become worse. The initial pain and discomfort in the lower back region may discourage one from continuing the exercises long enough to strengthen the muscles. Thus, those probably most in need of stronger abdominal muscles may not continue to perform the exercises, due to the pain, and those that that continue to perform these exercises may eventually develop back issues from the cumulative insult.

Trunk flexion motion generated during abdominal exercises cannot be prevented by the use of current abdominal tools currently on the market. None of these products extend the lumbar curve with the appropriate density of material and surface area to prevent the discomfort or possible injuries described above. The force caused by backward pelvic tilt and trunk flexion motion, therefore, is not prevented with balls, discs or any of the many exercise products available.

It is known to use a chiropractic wedge for passive traction to remold the shape of the spine. A user lies on a wedge to realign the spinal column, for example, after an injury. The soft foam material that a patient passively lies on is designed with the notion of remolding spinal ligaments much the same as braces change the position of teeth. In order for the chiropractic wedges to be comfortable, however, they are made of material having a very soft density, which is not adequate for the purposes of exercise therapy. These wedges do not provide the necessary support for active exercise regimens, such as crunches and other abdominal exercises. Moreover, the continuous nature of such exercises would quickly wear down the materials. Further, the wedges previously used for passive traction may not provide enough support for the spinal column to prevent injury and discomfort during active exercises.

SUMMARY OF THE INVENTION

The embodiments of the present invention disclose a support having a foam material that, when used during exercises, reduces back strain and improves the strengthening of the abdominal muscles. The disclosed support allows the spine to remain substantially extended for effective abdominal conditioning. Unlike the wedges used for passive traction described above, the disclosed embodiments remain resilient and effective when used for active exercises.

The support may be placed at the lower back positioned upwards from the hip bone to provide support to the lower back vertebrae during exercises. The placement and composition of the support helps prevent the backward pelvic tilt to reduce the force applied to the lower back vertebrae so that crunches and other abdominal exercises do not damage the spine or the discs between the vertebrae. The abdominal muscles are exercised over a greater range of motion. Thus, the potential for injury is reduced while the benefits of doing the exercises are increased according to the disclosed embodiments.

The support is preferably made of a foam rubber material with a specific density to support the weight of the user and to create a slightly labile surface. The foam is preferably enclosed in a vinyl covering for ease of cleaning and to preclude absorption of liquids such as water. In an alternative embodiment the support may include a cover material surrounding a foam material having a density to support the weight of a user during exercises. The support also may include a top portion and a bottom portion. The top portion engages the lower back area of the user and compresses inwardly. The top portion is connected to the bottom portion of the support with inclined side portions. The support is shaped so that the spine remains extended during abdominal exercises.

The density of the product of the invention is large enough that even with weight bearing down on the wedge from the force of an exercise, an extended lower back (lumbar spine) is nevertheless maintained. Maintaining the spine in an extended position is how the wedge product of the invention prevents injury to the lower back, extension being the opposite of flexion. None of the products on the market today performs this function of maintaining extension in the spine.

The article of the invention preferably is made of a blend of NBR and PVC and is of an adequate density to support the spine in extension during exercise. The material must also be soft to avoid contact irritation of the spinal bones against the wedge. If the material were made of PU or PE foam at an adequate density to prevent PPT during exercise the material would be too hard, and it would put excessive pressure against the spinous process and create sensitivity of those bones and the ligament. This is known as contact irritation.

If the material were made from other foams that were soft enough so as not to create contact irritation, then the material would not adequately support the spine in an extended position. In addition, the cell walls of typical foams break down quickly and the material loses its density quickly. The NBR/PVC blend is very durable and the material will not begin to break down for about 15 years.

The slightly labile nature of the wedge is also important to its effectiveness. Surfaces that are slightly labile enhance the greatest amount of proprioception or neuromuscular coordination in the spine. This proprioception is one way to develop stability in spines. Surfaces that are not labile such as firm foams, rolled up towels, etc have been found not to aid proprioceptive development. Surfaces too labile, such as inflated bladders or balls will also not enhance proprioception as effectively as materials that are only slightly labile.

The shape of the wedge is trapezoidal. This shape is designed to penetrate the spine to maximize the extension of the lower back. At the same time, the trapezoidal shape creates some longitudinal traction of the spinal column, which is called long axis distraction. Long axis distraction cannot occur if the shape is rounded or domed. Also spine penetration is not as great if the shape is round or domed.

Spine penetration is important to the success of the wedge because this is what creates pressure on the supportive ligament tissue of the spine. This ligament remolds and scars from the creeping process and becomes stiff and rigid. The ligament loses its pliability or elasticity from creep. Spine penetration puts pressure on this ligament in extension alleviating the pressure and stress from the flexed position. This is called ligament unloading. The unloading allows the ligament to realign its collagen fibers and restore its natural elasticity.

Spine penetration is so important that the while using the product the gluteus muscles or buttocks preferably does not touch the floor, and any such contact that does occur is merely incidental and does not prevent substantial penetration. The buttocks are therefore suspended in the air, i.e., by hanging off the edge of the wedge, so the back may bend into extension appropriately. If a participant has a particularly stiff spine and experiences any discomfort from this position, then moving the wedge approximately ½ inch toward the feet will make the back comfortable but still create adequate extension. With these small adjustments in position there is no need for variable densities within the wedge. There is no need for holes in the wedge to alter densities. Even the most sensitive backs will adapt very quickly to the optimum density of the wedge with these minimal positional adjustments.

The preferred dimensions of the wedge in inches are 12 wide×9 long×4 inches in height. This size allows one size generally to fit any person 5 feet in height or more. Extremely tall users can still use the wedge because of the high density of the material and the fact that the product is placed just above the belt line so the buttocks does not contact the floor.

The width of the top is approximately 2.5-3 inches and allows the back to arch over the wedge. This width will allow the product to fit any adult over 5 feet tall. If the product is less than 2.5 inches in width, the density of the product creates too much spine penetration for the average user and not enough long axis distraction effect. If the width is greater than 3 inches, then spine penetration is reduced or removed.

Standard gym balls create no spine penetration due to their size, which varies from 45 cm to 65 cm in diameter. These balls span beyond the size of the lumbar spine. There is therefore no support to the lumbar spine in an extended position. A wedge shaped rubber bladder filled with air cannot create spine penetration unless the material has the strength to resist high internal pressure in which contact irritation will be created. If the volume of air is reduced to alleviate contact irritation then the bladder will become excessively labile and spine penetration will be minimized.

Discs filled with air offer no support for the lumbar spine in extension. The discs filled with air have an extremely labile nature and therefore are ineffective at enhancing spinal proprioception. The size of these discs span beyond the size of the lumbar spine.

Traditional abdominal exercises like crunches and leg raises are effective at strengthening the abdominal wall but create a substantial penalty to the lower back. The abdominal crunch generates approximately 730 lbs of load on the spine. The movement for these classic exercises is driven by the hip flexors. The movements used to strengthen the abdomen are trunk flexion motions. These exercises create posterior pelvic tilt further damaging the spine. Ironically traditional abdominal strengthening using these movements actually insult the spine at the same time as they strengthen the core. This is equivalent to brushing one's teeth very rigorously with a hard bristled tooth brush. While performing abdominal exercises on the wedge the hip flexors (psoas muscle) will engage to create trunk/hip flexion. However, the density, elasticity and shape of the wedge maintain extension in the spine in spite of hip flexor contraction. The elastic nature of the material with soft texture creates a slightly labile surface and no contact irritation.

Abdominal exercises that create trunk flexion accentuate the creeping process because of the forceful load placed on the spine in the flexed position. This accelerates the lengthening, fatigue and neuromuscular inhibition (creating instability) from creep. This helps to explain why elite athletes have earlier degeneration in their spines and greater incidence of disc herniation than the average population. The wedge prevents the acceleration of creep by maintaining an extended spine and in fact reverses the creeping effect. Maintaining an extended spine while performing abdominal exercises "unloads" the supportive soft tissues that have been subjected to creep. This unloading allows collagen remodeling of the ligament in the spine. Unloading these tissues also stops the neuromuscular inhibition from the proprioceptive muscles and ligaments in the spine. This allows the proprioceptive mechanism to become engaged again so that stability may begin to be introduced to the spine.

Because the central pivot point between lumbar flexion and extension is the disc nucleus, trunk flexion movements load the front portion of the nucleus and force it to migrate toward the back of the disc. The posterior wall of the disc that surrounds and contains the nucleus is subjected to thinning and weakening from the creeping process. Trunk flexion therefore places force on the front of the disc nucleus forcing it to push back against the weakened wall of the disc annulus. This is a mechanism for disc herniation. The wedge prevents the spine from going into flexion because it maintains the spine in an extended position, therefore there is potential to migrate the nucleus back toward the front of the disc away from the weakened annular wall.

The balance of benefit versus penalty to core strengthening lends insight as to why some are helped by these exercises and others are injured. If the core-strengthen benefit is greater that the penalty and damage to the spine the individual may feel some improvement in back pain. If the back penalty is greater than the core strength benefit, then the individual will feel the exercises are not beneficial or are worsening the condition. In these situations, those individuals with the weakest conditions often abandon exercises designed to help strengthen the spine.

Core strengthening exercises that do not create trunk flexion have been utilized by those informed of the damaging effects of these exercises. They have met with modest success at best. Avoiding trunk flexion movements may help to minimize the insult to the spine, but nothing has been done to unload the tissues that have undergone creep. Remolding of ligament subjected to creep to restore elasticity of this tissue cannot occur. Unloading these tissues is also essential to reversing the neuromuscular inhibition of the proprioceptive muscles and ligaments in the spine so that stability can be reintroduced to the spine.

Core muscles include transverse abdominus, internal and external oblique, diaphragm, pelvic-floor and the multifidi-muscles in the lower back. Transverse abdominus forms a common tendon with the oblique muscles that wraps around the lower back and attaches to the back of the lumbar spine. These muscles and the common tendon form a corset to support the lower back. Lying on one's back (supine) and contracting the abdominal wall still engages the hip flexor muscles and creates a posterior pelvic tilt. This will occur even if the trunk is not flexed as in an isometric contraction and is due to the dominance of the hip flexors secondary to adaptive shortening. Maintaining an extended lumbar spine while on the wedge prevents posterior tilt. Using an isometric contraction can be very helpful in this instance for a severely de-conditioned individual who lacks the strength to lift the torso from the floor. The extended lumbar spine maintained by the wedge forces the abdominal wall to contract with greater effort to enhance core strength more effectively and safely.

The use of devices to create passive extension traction in backs has received some attention. Passively lying on devices to put the spine in extension is very uncomfortable if the material is dense enough to create appropriate spine penetration. Much the same as putting braces on teeth then tightening the wire to remold the position of teeth by remolding the ligament. The method, however, shows no changes on pre and post x-ray analysis. This is predictable once we understand the structural shape change of the spine is secondary to creep of the supportive soft tissue from sitting. Remolding cannot work as long as we continue to sit. The orthodontic analogy would be wearing a retainer for 10 minutes a day with the expectation of changing the position of the teeth.

To lie comfortably on extension devices the material must be soft and of a density that will not create inappropriate spine penetration. Otherwise the device may have a longitudinal slot cut in it for the spine. In this case the back is arched but there is no direct pressure to the spine so there is no remolding of the ligament. The devices can provide some temporary relief but will not unload the ligament or proprioceptors in the spine.

The wedge placed under the lower back acts as a fulcrum point. This means lifting the torso from the floor takes a greater force of contraction which enhances the core strengthening. The hip flexors still contract, but the wedge maintains the extended position of the lumbar spine. When the force of contraction increases, the hip flexors push the spine into the wedge with greater force. This force accelerates the development of the elastic remodeling of the spinal ligament benefitting the spine by reducing stiffness in these ligaments. The wedge therefore creates faster elastic change in the ligament because of greater pressure than lying passively. Because the pressure comes from active exercise rather than passively lying, there is no discomfort to the participant. Because the spine is extended while lying on the wedge the action of the exercises requires a larger range of motion (ROM) in order to perform the movement. This also enhances the effectiveness of core strengthening while protecting the spine at the same time.

Supporting spines in extended positions has been shown to restore circulation of disc fluids and restore loss of disc height from sitting on a daily basis. Disc fluids need to circulate to nourish the walls of the disc. Even weight distribution between the disc and the joints of the spinal column is best maintained from adequate circulation of disc fluids. Loss of disc fluid circulation leads to rapid breakdown of both the disc and the posterior joints. The wedge places the spine in the appropriate position to restore circulation of disc fluids.

While the preferred shape of the support is that of a trapezoidal prism, other effective shapes may be developed, which will be apparent to those of skill in the art.

BRIEF DESCRIPTION OF THE DRAWINGS

The features and advantages of the embodiments of the present invention, and the manner of attaining them, will become more apparent and better understood by reference to the following brief description of the drawings listed below. The following description of the preferred embodiments of the invention may be taken in conjunction with the accompanying drawings.

DETAILED DESCRIPTION OF THE INVENTION

Figure 1:
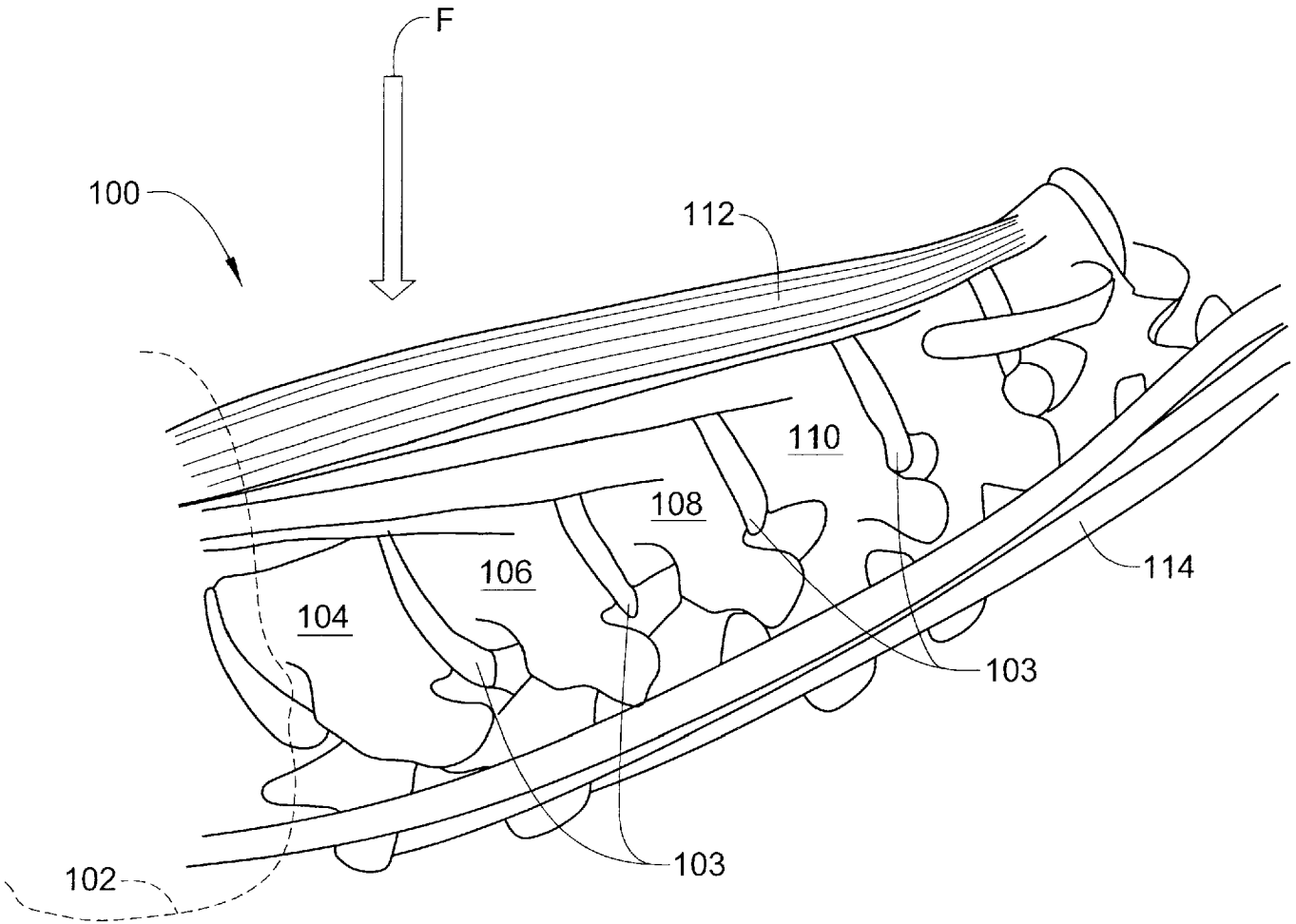
FIG. 1 illustrates a diagram of a back under stress during routine exercise according to prior art methods.

While the present invention includes various modifications and alternative forms, the preferred embodiments are shown by way of example in the following description and drawings. Objects, features and characteristics of the present invention, as well as the methods of operation and functions of related elements of any structure, and the combination of parts, will become apparent upon consideration of the following description and the appended claims with reference to the above-described drawings. The drawings form a part of this specification, wherein the same reference numeral designates corresponding parts in the various drawings.

Figure 2A:
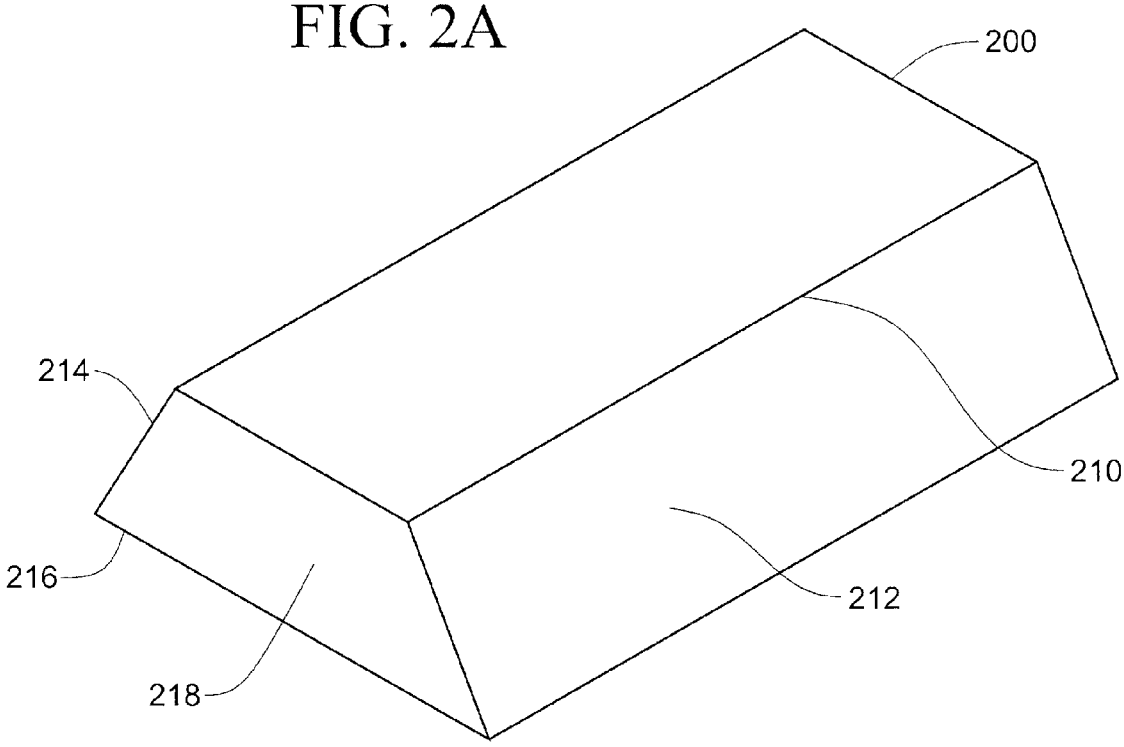
FIG. 2A illustrates a wedge according to the disclosed embodiments.
Figure 2B:
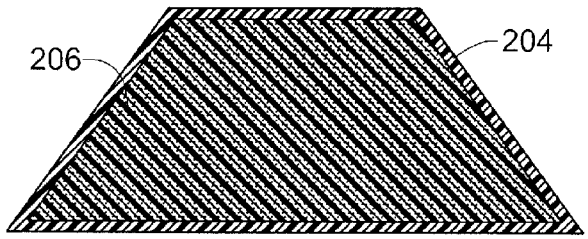
FIG. 2B is a transverse cross section thereof.

FIGS. 2A and 2B depict a support 200 for use during abdominal exercises according the disclosed embodiments. Support 200 preferably has a thin vinyl coating 204 but could have a thicker or even separate cover material (not shown) surrounding a foam material 206. In the preferred embodiments, the support 200 is shaped as a wedge that is a trapezoid in cross section, as shown in FIG. 2*a*.

The density of foam material 206 from which support 200 is made allows support 200 to maintain the spine in an extended position during exercise to reduce the backward pelvic tilt of the lower back vertebrae, described with respect to FIG. 1. Foam material 206 is preferably a blend of acrylonitrile butadiene rubber (NBR) and polyvinyl chloride (PVC). The foam material preferably has a maximum gauge of about 1.25 inches or about 30 millimeters. Foam material 206 may come in any color, but preferably natural or black. Foam material 206 also has a density of about 3.5-5.0 lb/ft$^3$ or about 0.06-0.08 g/cm$^3$, which equals 60 kg/m$^3$.

This density is greater than that of typical chiropractic wedges in order to ensure durability while providing the appropriate level of comfort and support for a user during abdominal exercises. Traditional chiropractic foam wedges are made of polyethylene or polyurethane having a density of about 4 kg/m$^3$, or 0.004 g/cm$^3$. The cells of the typical chiropractic foams generally fracture quickly with little use and cannot provide the effective support for exercise provided by the device of the invention.

Foam material 206 also may have a compression deflection of about 25%, or about 2.0-5.0 lb/in$^2$ or about 0.14-0.35 kg/cm$^2$. Foam material 206 avoids the breakdown experienced with typical chiropractic wedges by having a higher density. Other preferable features and their specifications of foam material 206 may be found in Table 1. Alternatively, foam material 206 may comprise any appropriate foam material, and is not limited to the specifications and features disclosed above.

Further, foam material 206 may be divided into different sections having different densities. For example, foam material 206 may include three sections, with a middle section having a greater density than two outer sections. Moreover, foam material 206 may have holes or indentations that vary the amount of support provided while doing exercises along the lower back area.

Support 200 is ready for use in exercises according to the disclosed embodiments. Support 200 includes a top portion 210 and a base portion 216. Base portion 216 is greater in surface area than top portion 210. Although the top is preferably substantially flat, as shown, it may in certain be slightly curved, or include features such as a small indent in the middle to align with the spine during exercise. During use, top portion 210 engages the lower back area of the user while base portion 216 lies on a flat surface, such as a floor. Top portion 210 and base portion 216 are connected by side portions 212 and 214, and end portions 218. Side portions 212 and 214 may be longer than end portions 218.

Side portions 212 and 214 incline inwardly at an angle from base portion 216 to the length of top portion 210. Side portions 212 and 214 are preferably oriented at the same angles to the base 216 and top 210 whereby the support is symmetrical about a longitudinal axis so the user can orient it easily. It is possible, however, that a side portion 212 could be inclined at a greater angle than side portion 214. Thus, the support 200 of the preferred embodiment may be positioned by a user with side portion 212 engaging the portion of the back closest to the hip bone while side portion 214 faces towards the upper back, or vice-versa.

Figure 3:
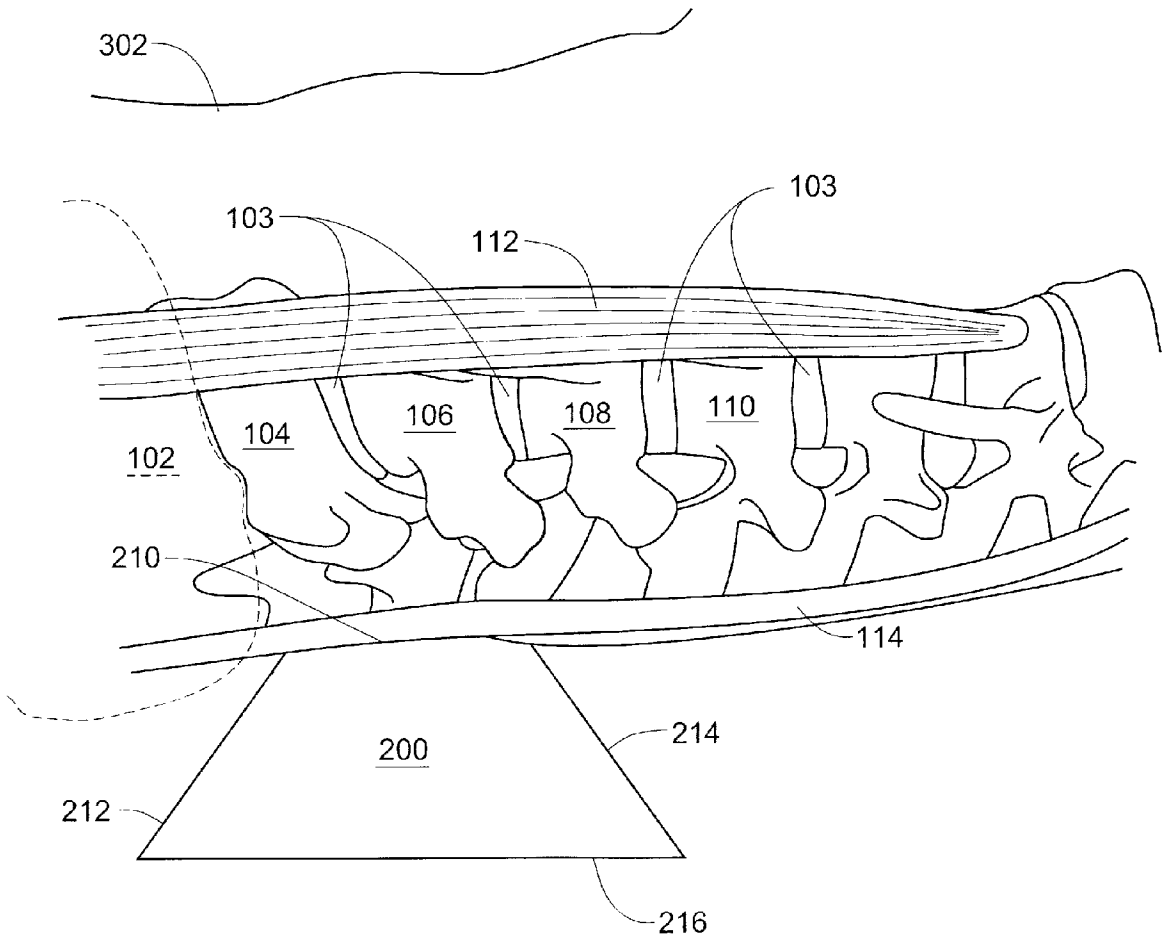
FIG. 3 illustrates the wedge engaging the lower back region of a user according to the disclosed embodiments.

FIG. 3 depicts support 200 engaging the lower back region of a user according to the disclosed embodiments. Support 200 compresses downwards to provide support for vertebrae 104-110 and to keep them in a substantially extended position during abdominal exercise. The substantially extended position serves to prevent backward pelvic tilt. Side portion 212 faces hip bone 102 while side portion 214 faces towards the upper back region of the user.

During crunches, sit-ups and the like, base portion 216 lies flat on a surface. A user also may lie across support 200 prior to doing an exercise. As the upper torso of the user rises off the surface, the lower back area of the user presses down on support 200. Vertebrae 104-110 remain extended during the exercise due to support 200. The force generated by doing normal abdominal exercises by curving the spine may be offset or prevented because vertebrae 104-110 remain substantially aligned. Spinal discs 103 remain uncompressed so that discomfort is reduced along with the potential inflammation caused by the vertebrae pushing together.

Top portion 210 of support 200 is pushed downwards as the user does a crunch or sit-up. Support 200 allows for some movement of vertebrae 104-110, which puts pressure on supportive structure and enhances natural elasticity of the ligament tissue. If support 200 remained hard and unyielding during the exercise, then irritation of the vertebral spinous processes would occur resulting in contact irritation. Additionally, the beneficial proprioceptive effect would be lost if the surface were hard.

Because the back remains substantially extended during the exercises, abdominal muscles 302 work through a larger range of motion when compared to typical abdominal exercises. Thus, a user may increase the effect of doing known abdominal exercises by using support 200.

Moreover, the elasticity of the spine is enhanced during abdominal exercises by the use of foam material 206 in support 200. The act of passively lying on a chiropractic wedge may increase spinal elasticity over time, but this is a slow and painful process and does not strengthen core muscles. By using support 200 during exercise, however, spinal elasticity may increase quicker than using traditional wedges because of the greater presser applied to the spine while extended. Further, the back discomfort associated with a passive protocol is reduced due to the active motion. Support 200 compresses due to the force from the backward pelvic tilt, or spinal loading. Support 200 counteracts that force by pressing upwards on the spine to increase spinal ligament elasticity. Thus, core strengthening occurs at the same time that the elasticity of the spine is increased by doing abdominal exercises with support 200.

The resiliency of support 200, as set forth by the specifications listed in Table 1, causes support 200 to respond to the differing forces created by body weights of the users. These features help support 200 remain usable by different types of bodies and physical types. Essentially, support 200 may be a "one size fits all" item for improving abdominal exercises.

Figure 4:
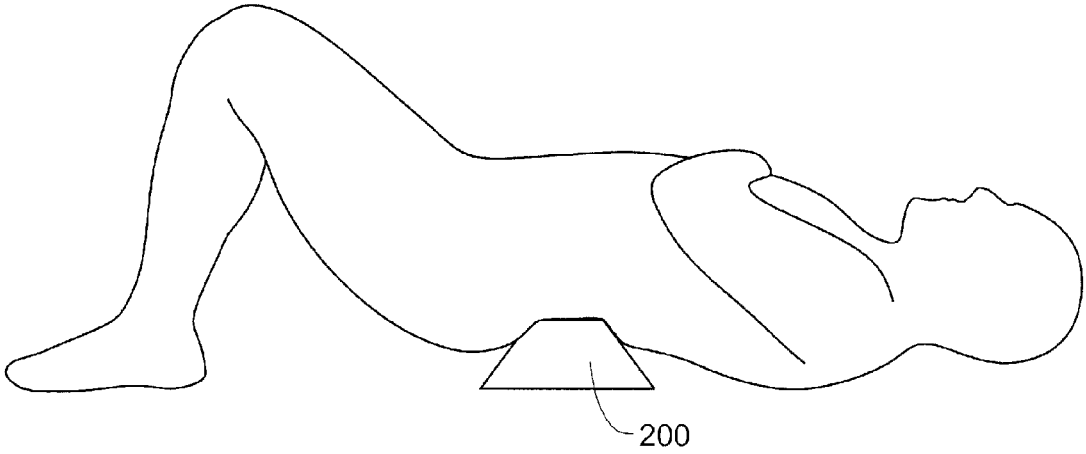
FIGS. 4 and 5 illustrate an exercise routine that includes using the wedge to strengthen abdominal muscles while preventing strain on the lower back according to the disclosed embodiments.
Figure 5:
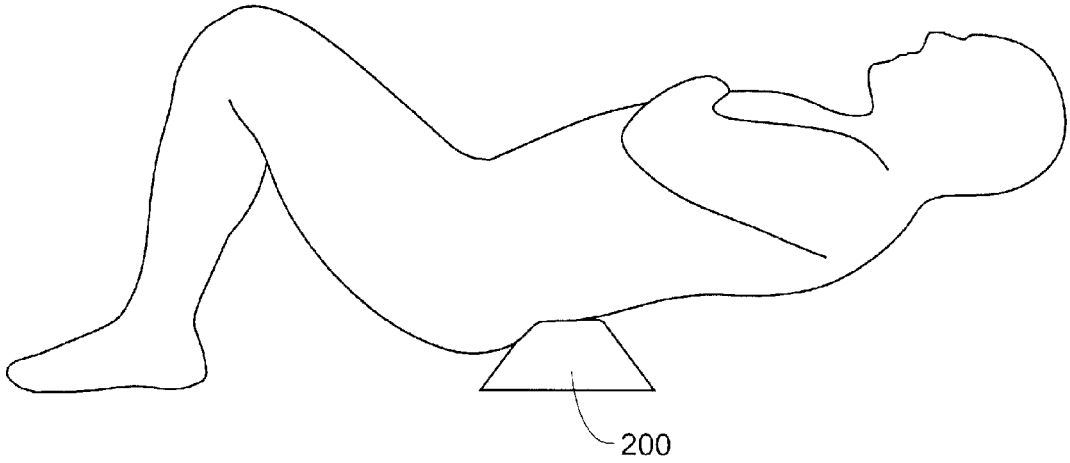

FIGS. 4 and 5 depict an exercise routine using support 200 that strengthens abdominal muscles while preventing strain on the lower back vertebrae according to the disclosed embodiments. Specifically, FIGS. 4 and 5 illustrate use of support 200 for a particular abdominal exercise, but it may be used to advantage with any number of abdominal exercises. Thus, support 200 is not limited for use with traditional crunches or sit-ups. Further, support 200 can be placed on any flat surface at home, the gym, weight room and the like. Support 200 also can be conveniently stored or carried, and does not require any special equipment or mats.

Referring to FIGS. 4 and 5, a method for using wedge 200 is shown. The method may include placing the wedge on a flat surface. Top portion 210 engages the lower back area of a user. A side portion 212 faces the hip bone of the user. The user lies across top portion 210. Support 200 compresses inwardly during the exercises and presses against the lower back area. The backward pelvic tilt is prevented because the spine remains in a semi-extended position during the exercises. Without the backward pelvic tilt, the force associated with known abdominal exercises is reduced.

As the user performs a crunch or other exercise, vertebrae 104-110 press against support 200. Support 200 allows the motion of the back keeps the vertebrae substantially aligned in an extended position during the exercise. That is, support 200 deforms enough to keep the spine in a position to prevent backward pelvic tilt. Further, support 200, as disclosed above, is preferably of uniform density, but it may include different sections, with each having a different density, so that support 200 can provide more or less support at selected locations. As the user moves his/her upper body back to the floor, support 200 presses upwards to keep the spine aligned properly.

Support 200 also may be used in exercises, such as leg raises, that lift the legs of the user off the surface while the back remains flat. Support 200 keeps the lower back vertebrae in a substantially extended position to reduce any force exerted on this region of the spine, much like reducing the force associated with backward pelvic tilt. Support 200 also may prevent the spine from being pressed flat against a surface. As disclosed above, the compression of support 200 results in a counteracting force that presses upward onto the spine of the user to promote spinal elasticity. Thus, the use of support 200 during leg raises also provides this benefit.

TABLE 1

| | UNITS | TEST METHOD | NBR/PVC FOAM |
|---|---|---|---|
| Max. gauge | Inches | | 1.25 |
| | Mm | | 30 |
| Color | | | Natural/black |
| Density | lb/ft.$^3$ | | 3.5-5.0 |
| | gm/cm$^3$ | | 0.06-0.08 |
| Compression Deflection (25%, psi) | lb/in$^2$ | ASTM D1056 | 2.0-5.0 |
| | kg/cm$^2$ | | 0.14-0.35 |
| Compression Set (50%) | % max. | ASTM D1056 | 20-30 |
| Water Absorption (vacuum method) | Wt. % Max | ASTM D1056 | 5-8 |
| Water absorption | Lb/ft$^2$ | ASTM D1667 | 0.1 |
| Heat aging (7 days @ 158° F.) Lineal shrinkage | % Max | ASTM C548 | 5 |
| Tensile strength | Lb/in$^2$ | ASTM D412 | 55-70 |
| | Kg/cm$^2$ | | 4-5 |
| Elongation | % Min | ASTM D412 | 200-250 |
| Thermal conductivity | BTU in/hr ft$^2$ ° F. Max | ASTM C117 | 0.25 |
| Specification | | ASTM D1056-68 | SCE-41 |
| | | ASTM D1056-91 | 2C1 |

While the present invention is disclosed in connection with the most practical and preferred embodiments, it is to be understood that the present invention is not to be limited to the disclosed embodiments. In fact, the description above of the present invention is intended to cover various modifications and arrangements included within the spirit and scope of the claims and their equivalents.

I claim:

1. A method of performing an abdominal exercise comprising lying on an apparatus on a substantially flat surface such that said apparatus penetrates the spine and performing said abdominal exercise while maintaining anterior pelvic tilt with the entire buttocks suspended above said surface throughout said exercise, wherein said apparatus comprises a body of foam in the shape of a wedge configured to penetrate the spine during said abdominal exercise, said foam having a density such that throughout performance of said abdominal exercise the apparatus provides a supporting resistive force that supports the spine to maintain the entire buttocks suspended above said surface and to maintain the spine in an extended position.

2. A method according to claim 1 wherein the density of said foam is in the range of from about 3.5 lb/ft$^3$ to about 5.0 lb/ft$^3$.

3. A method according to claim 2 where said foam comprises a plurality of layers of foam having a maximum thickness of about 1.25 inches.

4. A method according to claim 1 wherein the compression deflection of said foam is about 25%.

5. A method according to claim 1 wherein said foam comprises a blend of NBR and PVC.

6. A method according to claim 1 wherein said body of foam is trapezoidal in cross section and about twelve inches wide, about nine inches long, about four inches in height and about 2.5 to about three inches wide at an upper surface.

7. A method of performing an abdominal exercise by a user comprising lying on an apparatus on a substantially flat surface such that said apparatus penetrates the spine and performing said abdominal exercise while maintaining anterior pelvic tilt with the entire buttocks suspended above said surface throughout said exercise, wherein said apparatus comprises a body of foam in the shape of a wedge configured to penetrate the spine during said abdominal exercise, said foam having a density such that throughout performance of said abdominal exercise the apparatus provides a supporting resistive force that is greater than the force required to flatten the user's spine to thereby support the user's spine, maintain the user's entire buttocks suspended above said surface, and maintain the spine in an extended position.

* * * * *